United States Patent [19]

Nakagawa et al.

[11] 4,192,403

[45] Mar. 11, 1980

[54] MUFFLER FOR INTERNAL COMBUSTION ENGINES

[75] Inventors: Takashi Nakagawa, Tokorozawa; Tadashi Sugiuchi, Niiza; Kanau Iwashita, Tokyo, all of Japan

[73] Assignee: Honda Giken Kogyo Kabushiki Kaisha, Tokyo, Japan

[21] Appl. No.: 908,904

[22] Filed: May 23, 1978

[30] Foreign Application Priority Data

May 26, 1977 [JP] Japan ..... 52/67793[U]

[51] Int. Cl.[2] ..... F01N 1/08

[52] U.S. Cl. ..... 181/268; 181/272; 181/275

[58] Field of Search ..... 181/264, 265, 269, 272, 181/273, 275, 276, 255, 268

[56] References Cited

U.S. PATENT DOCUMENTS

| | | | |
|---|---|---|---|
| 2,083,840 | 6/1937 | Haas | 181/273 |
| 2,784,797 | 3/1957 | Bailey | 181/255 |
| 2,838,128 | 6/1958 | Kliewer, Sr. | 181/264 |
| 3,987,868 | 10/1976 | Betts | 181/269 |
| 4,011,922 | 3/1977 | Goplen | 181/272 |

FOREIGN PATENT DOCUMENTS

| | | | |
|---|---|---|---|
| 527934 | 4/1954 | France | 181/255 |

*Primary Examiner*—L. T. Hix
*Assistant Examiner*—Benjamin R. Fuller
*Attorney, Agent, or Firm*—Irving M. Weiner; Pamela S. Burt

[57] ABSTRACT

A muffler for internal combustion engines having the interior of an expansion chamber sectioned by a porous plate through which an exhaust inlet pipe is extended. The inlet pipe is closed at its down-stream end and is provided with many perforations in that part of the inlet pipe positioned in the expansion chamber. Such perforations permit the inlet pipe to communicate with the interior of the expansion chamber in the muffler.

5 Claims, 5 Drawing Figures

MUFFLER FOR INTERNAL COMBUSTION ENGINES

The present invention relates generally to improvements in mufflers for internal combustion engines.

More particularly, the invention relates to an expansion type muffler interposed in the exhaust system of internal combustion engines wherein a partition plate is provided within an expansion chamber to section the interior of the chamber. The plate is provided with many perforations to make the sectioned chambers communicate with each other. An exhaust inlet pipe is transversely provided in the one chamber, and extended at a closed end to the interior of the other chamber sectioned by the partition plate. The inlet pipe is provided with many perforations in its peripheral wall to prevent noise generation from the outer wall of the muffler body, and to accordingly improve the silencing effect.

BACKGROUND OF THE INVENTION

In an internal combustion engine, noise is generated with the exhaust. Such exhaust noise is caused: by pressure waves generated by the difference between the pressure in the cylinder, and the pressure in the exhaust pipe at the moment when the exhaust valve is opened; by resonance in the pipe amplified and generated when the pressure waves reciprocate within the pipe; and by air current, i.e., the current of the exhaust.

An expansion type muffler, resonance type muffler, interference type muffler, sound absorption type muffler, and a muffler of a type combining the above mentioned types have already been proposed for eliminating exhaust noise.

In the expansion type muffler, an expansion chamber with a volume larger than that of the exhaust pipe is provided in the exhaust system so that the exhaust may be introduced into the expansion chamber, and the sound wave component may be attenuated in the chamber to silence the noise. It is known that this kind of expansion type muffler can silence the noise over a wide frequency range from a low sound range to a high sound range.

In such an expansion type muffler, there appears periodically a frequency passing band range in which noise is not silenced at all depending on the size of the expansion chamber. In view of the fact that a better silencing effect is obtained by eliminating such passing band, the frequency of this passing band has been shifted to a higher frequency range conventionally by dividing the expansion chamber or selecting the opening positions of the communicating pipes, i.e., providing the openings at different positions between the front and rear walls. However, there still exists the following problems.

In the event that the expansion chamber is divided, the volume per chamber would be decreased so that the back pressure to the engine would become somewhat higher than in a one-chamber type, and this exerts an adverse effect on the engine output. Further, the silencing effect of the low frequency range would be reduced due to the decrease of the chamber volume. In case the communicating pipe opening positions are provided at different positions relative to each other on the front and rear wall of the chamber, a void resonance of the passing band frequency would remain within the chamber to act as pressure waves on the muffler wall and would vibrate same to generate a wall vibration noise, such as so-called vibration sounds. This would also be the case if the interior of the expansion chamber is sectioned into a plurality of chambers, and the positions of the communicating pipes are differently selected on the respective chamber walls.

Therefore, there has been proposed a muffler wherein the partition plate, sectioning the interior of the expansion chamber, comprises a porous plate so that, by the presence of the perforations in the partition plate, a mode passing through the perforations and a mode generated on both sides of the partition plate may be produced. Due to such construction, the modes generated by the division are attenuated by the porous plate, the resonance caused in the sectioned chambers is prevented, the silencing effect within the muffler is increased, and the vibration sounds of the outer wall of the muffler by the resonant vibrations can be controlled.

Such muffler should have retained, by the presence of the porous partition plate, the features of a one-chamber type muffler and a divided-chamber type muffler to solve the problems as aforesaid. However, even in such muffler, the defect of the divided-chamber type remains. That is to say, because the interior of the expansion chamber is sectioned with the partition plate, the back pressure to the engine cannot help but become somewhat higher than in the one-chamber type so that the engine output is decreased.

The present invention effectively solves the above problems.

SUMMARY OF THE INVENTION

The present invention provides a muffler for an internal combustion engine, and comprises a muffler body having an expansion chamber therewithin. A porous plate is disposed within the muffler body and sections the expansion chamber. An exhaust inlet pipe extends through the porous plate. The exhaust inlet pipe is closed at its down-stream end. The exhaust inlet pipe is provided with a plurality of perforations in the portion thereof disposed in the expansion chamber to communicate with the interior of the expansion chamber.

An object of the invention is to provide a muffler interposed in the exhaust system for internal combustion engines. The muffler includes an expansion chamber having a volume much larger than that of the exhaust pipe and communicates with both the up-stream and down-stream of the exhaust, wherein the interior of the expansion chamber is sectioned with a porous partition plate. An exhaust inlet pipe is led into the chamber passing through the porous plate to be present in both chambers. The inlet pipe is closed at the end at the down-stream side and is provided with many perforations in the outer peripheral wall present in both chambers.

Another object is to provide a muffler for internal combustion engines having the following advantages: the resonance generated within the chamber is controlled and attenuated as much as possible by the presence of a porous partition plate; the generation of the vibration sounds by the resonance of the muffler body is prevented as much as possible; the silencing performance is excellent; and noise of the muffler itself is prevented.

A further object is to provide a muffler for internal combustion engines having such advantages that, due to the structure of an exhaust inlet pipe as aforementioned, the ventilation resistance is reduced as much as possible;

any adverse influence on the engine output is reduced; and the engine performance is improved while increasing the silencing effect.

Another object is to provide a muffler for internal combustion engines having such advantages, and wherein the interior of the expansion chamber is sectioned by a porous plate, and an exhaust inlet pipe closed at one end and provided with many perforations is only passed through the porous plate. This results in a muffler that is simple in structure, excellent in silencing performance, and favorable to engine performance.

DETAILED DESCRIPTION

Figure 1:
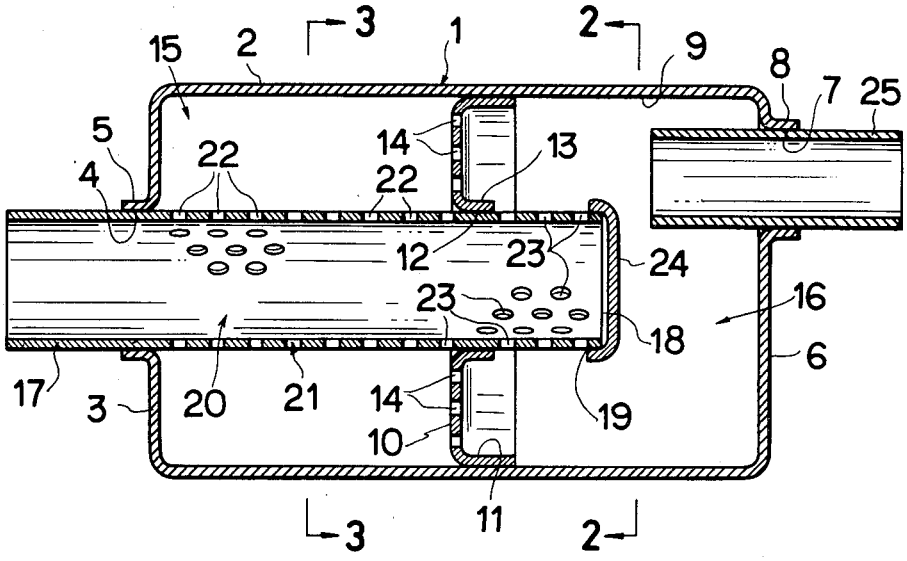
FIG. 1 is a vertically sectioned side view of a muffler according to the present invention.
Figure 2:
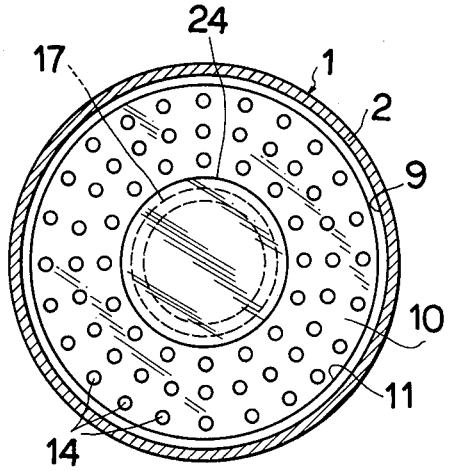
FIG. 2 is a sectioned view on line 2—2 in FIG. 1.
Figure 3:
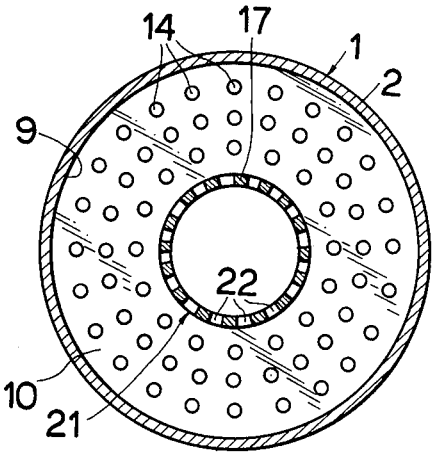
FIG. 3 is a sectioned view on line 3—3 in FIG. 1.

In FIGS. 1 to 3 showing a first embodiment of the present invention, a body 2 of a muffler 1 is formed like a cylinder which is closed in the front and rear with wall plates 3 and 6, respectively. A partition plate 10 is provided in the intermediate or central part in the lengthwise direction of body 2 to section the interior thereof to form a front expansion chamber 15 and a rear expansion chamber 16. Plate 10 contacts, at the outer surface of a flange 11, with the inner wall 9 of body 2, and is connected with the inner wall by spot-welding or the like so as to be integral with the body 2.

Plate 10 is provided with many perforations 14 perforated through in the thickness direction. Chambers 15 and 16 communicate with each other through these perforations 14, and are sectioned from each other with the blind or solid parts between perforations 14.

A central hole 4, having a flange 5 projected outwardly, is made in the central part of plate 3. A central hole 12, having a flange 13 projected rearwardly, is concentrically formed in the central part of plate 10. An exhaust inlet pipe 17 is fitted, inserted, connected and secured through holes 4 and 12 in such manner that the inlet pipe 17 enters chamber 15 through the hole 4, traverses the chamber in the axial direction, passes through hole 12, projects into chamber 16 for a suitable length, and is connected and supported on the inner surfaces of flanges 5 and 13.

Many perforations 21 are provided in the outer peripheral wall of the exhaust inlet pipe 17 positioned in chambers 15 and 16. A passage 20 connected with the up-stream of the exhaust within pipe 17 is made to communicate with the interiors of chambers 15 and 16 through perforations 22 and 23, respectively, of the perforations 21 of the pipe 17. The opening end 18 at the tip of pipe 17 extended into chamber 16 is closed with a cap-shaped closing member 24.

A hole 7, provided with a fitting flange 8 in the same manner as mentioned with respect to the holes 4 and 12, is formed in the upper part of plate 6. Hole 7 has an exhaust outlet pipe 25 fitted, inserted and secured therein to connect chamber 16 with the exhaust system and silencing system in the next stage.

The operation will be explained as follows.

The exhaust flows into the chambers through passage 20 within pipe 17. As the pipe 17 is closed at its tip end, i.e., its down-stream end, with the closing member 24, the exhaust flows into chambers 15 and 16 through the many perforations 21 provided in the entire peripheral wall of pipe 17 over the entire length positioned in the chambers, that is, into the respective chambers 15 and 16 through the perforations 22 and 23 corresponding respectively to the chambers. The exhaust in the front chamber 15 flows into the rear chamber 16 through perforations 14 in plate 10. The exhaust, having flowed into chamber 16 through the perforations 23 on the peripheral wall of pipe 17, flows out into the silencing system and exhaust system in the next stage through outlet pipe 25.

In such a structure, the sound waves are attenuated and silenced within chambers 15 and 16, but the frequency of the passing band has three modes consisting of two modes by the reflection between plates 3 and 6, respectively, and the intermediately interposed partition plate 10, and a mode reflected between plates 3 and 6 through the perforations 14 of plate 10. Thus, modes, which differ from the conventional patterned divided type modes, are obtained and are combined in a cancelling fashion within the chamber. Therefore, the sound pressure in the above-mentioned frequency range does not produce a pronounced resonance. The influence of the sound pressure on the peripheral wall of body 2 is reduced as much as possible to prevent generation of vibration sounds by resonance of the peripheral wall. Further, the sound waves reflected between plates 3 and 6 by the presence of porous partition plate 10 are attenuated as much as possible according to the three modes obtained by the presence of the perforations, and consequently, the resonance is reduced as much as possible. Further, the sound waves within the expansion chamber are not only attenuated by reflection between the peripheral wall of body 2 and pipe 17, but also, as pipe 17 is provided with many perforations 21, the sound waves are attenuated as much as possible by such action and interference as the collision, reflection and absorption with the blind parts of plate 10 so that the silencing effect of the frequency outside the passing band is also improved.

Because pipe 17 is closed at its end with member 24 and communicates with both chambers 15 and 16 through the perforations 22 and 23, the flow resistance decreases to be less than that of conventional type mufflers having perforations in a partition plate. Therefore, in spite of the divided type of expansion chamber, the pressure within the exhaust and silencing systems is decreased as much as possible, and the influence on the engine output is improved.

Figure 4:
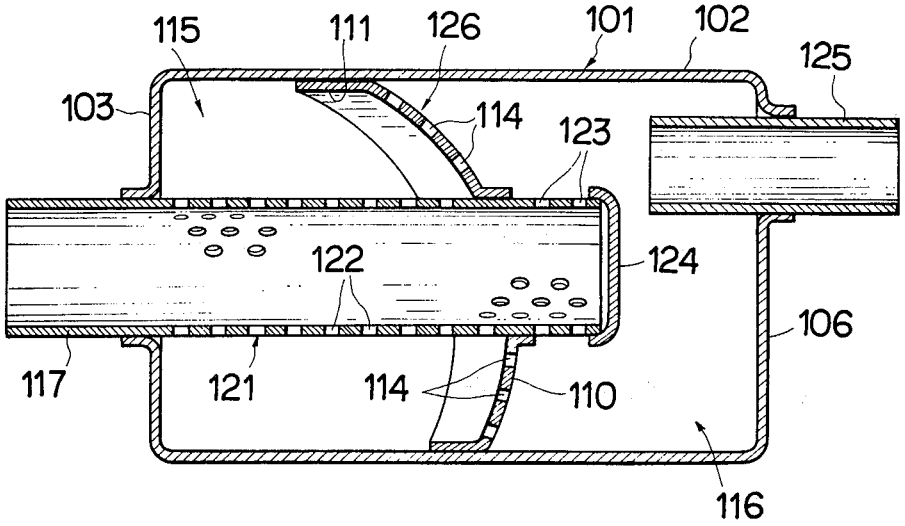
FIG. 4 is a vertically sectioned side view showing a modified embodiment of the present invention.

FIG. 4 shows a second embodiment of the present invention, wherein parts similar to those of the first embodiment are represented by adding the digit 1 in front of the respective corresponding numerals.

In this embodiment, a partition plate 110 sections the interior of body 102 of a muffler 101. Plate 110 supports an inlet pipe 117, and is curved and inclined to increase the rigidity of plate 110 so that the rigidity of body 102 is also increased, and the outer plate of the muffler may be reinforced and its vibration controlled. Further, due to the curved inclined surface 126 of plate 110, the modes between plate 110 and front and rear wall plates 103 and 104 are non-patterned and, with the presence of perforations 114, the resonance can be reduced more effectively. Also, the vibration of the outer plate and the generation of vibration sounds can be controlled as much as possible.

The partition plate 110 is curved and inclined, but the other parts are exactly the same as in the first embodiment. Accordingly, their explanation will be omitted.

Figure 5:
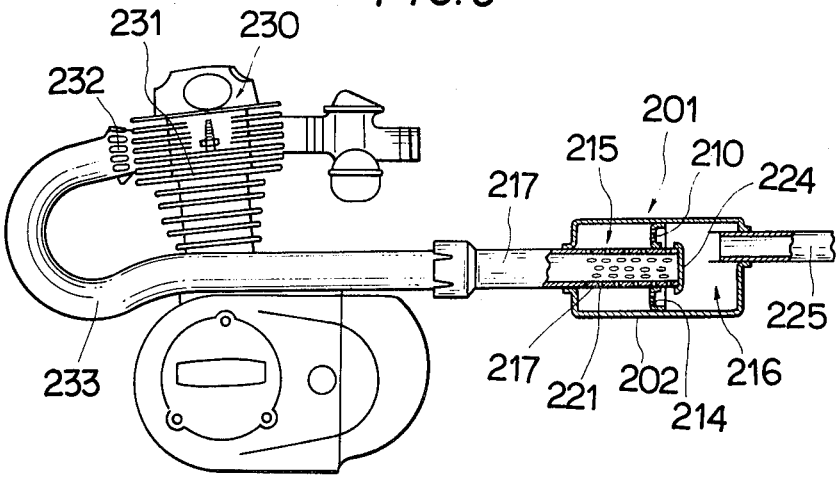
FIG. 5 is a side view of an embodiment provided with a muffler interposed in the exhaust system of an engine for motorcycles, with the essential part in section.

FIG. 5 shows a specific embodiment of the muffler of the present invention interposed in the exhaust system of a motorcycle. An internal combustion engine 230 for motorcycles has an exhaust pipe 233 connected at the base end to an exhaust port 232 of a cylinder 231 of engine 230 and at its terminal end to a connecting pipe comprising an exhaust inlet pipe 217. Pipe 217 is fitted and inserted in the lengthwise direction of body 202 of a muffler 201 supported on a car body or the like. Through a porous partition plate 210 provided within the body 202, the pipe 217 is extended in the first and second expansion chambers 215 and 216 within body 202. Perforations 221 are provided on a part of the pipe 217 positioned in body 202, and perforations 214 are also provided in plate 210. Pipe 217 is closed at its tip end with a closing member 224. The second chamber 216 is connected to the exhaust system and muffler in the next stage through an outlet pipe 225. Muffler 201 is similar to the first embodiment of FIG. 1.

By the above described structures, a motorcycle can be effectively silenced without any adverse influence on the engine performance.

We claim:

1. A muffler for an internal combustion engine, comprising:

a muffler body;

a porous plate disposed within said muffler body and sectioning the interior of said muffler body into front and rear expansion chambers;

an exhaust inlet pipe extending into said front expansion chamber through a front wall of said body, said exhaust inlet pipe extending through said front expansion chamber, through said porous plate, and into said rear expansion chamber;

said exhaust inlet pipe being closed at the downstream end thereof, said closed downstream end being disposed within said rear expansion chamber;

said exhaust inlet pipe being provided with a plurality of perforations in the portion thereof disposed in said front expansion chamber, such that the interior of said exhaust inlet pipe directly communicates with said front expansion chamber;

said exhaust inlet pipe being provided with a plurality of perforations in the portion thereof disposed in said rear expansion chamber, such that the interior of said exhaust inlet pipe directly communicates with said rear expansion chamber; and said rear expansion chamber being directly connected with the downstream side of an exhaust system through an exhaust outlet pipe.

2. A muffler according to claim 1, wherein:

said porous plate is disposed in a central portion in the lengthwise direction of said muffler body; and said front and rear expansion chambers together define substantially the entire interior volume of said muffler body.

3. A muffler according to claim 1 or 2, wherein:

said porous plate is substantially flat.

4. A muffler according to claim 1 or 2, wherein:

said porous plate is curved to have a curved surface.

5. A muffler according to claim 3, wherein:

said flat porous plate includes a substantially centrally disposed aperture for receiving therethrough said exhaust inlet pipe;

said porous plate further includes a plurality of perforations disposed substantially around said centrally disposed aperture; and said plurality of perforations in said porous plate permit direct communication of gases between said front and rear expansion chambers.

* * * * *